US007472760B2

(12) United States Patent
Stirm et al.

(10) Patent No.: US 7,472,760 B2
(45) **Date of Patent: *Jan. 6, 2009**

(54) VIBRATION REDUCTION APPARATUS FOR POWER TOOL AND POWER TOOL INCORPORATING SUCH APPARATUS

(75) Inventors: Michael Stirm, Oberursel (DE); Reimund Becht, Hühnfelden (DE); Norbert Hahn, Hühnstetten-Limbach (DE)

(73) Assignee: Black & Decker Inc., Newark, DE (US)

( * ) Notice: Subject to any disclaimer, the term of this patent is extended or adjusted under 35 U.S.C. 154(b) by 249 days.

This patent is subject to a terminal disclaimer.

(21) Appl. No.: 10/981,179

(22) Filed: Nov. 4, 2004

(65) Prior Publication Data

US 2007/0056757 A1 Mar. 15, 2007

(30) Foreign Application Priority Data

Nov. 4, 2003 (GB) ..... 0325638.5

(51) Int. Cl.
*B25D 17/24* (2006.01)
*B25D 17/00* (2006.01)

(52) U.S. Cl. ..... 173/162.1; 173/162.2; 173/90

(58) Field of Classification Search ..... 173/162.1, 173/162.2, 48

See application file for complete search history.

(56) References Cited

U.S. PATENT DOCUMENTS 1,358,486 A 11/1920 Wilhelm
2,629,364 A * 2/1953 Anderson ..... 403/81
2,630,784 A * 3/1953 Wallerstein, Jr. ..... 267/137
3,275,089 A 9/1966 Kaiser et al.
4,060,138 A 11/1977 Cox et al.
4,282,938 A 8/1981 Minamidate
4,371,043 A 2/1983 Kubokawa
4,401,167 A 8/1983 Sekizawa et al.
4,478,293 A 10/1984 Weilenmann et al.
4,611,671 A 9/1986 Hansson
4,667,749 A * 5/1987 Keller ..... 173/162.2
4,673,043 A * 6/1987 Greppmair ..... 173/162.2
4,711,308 A 12/1987 Blaas et al.
4,749,049 A 6/1988 Greppmair (Continued)

FOREIGN PATENT DOCUMENTS

DE 4124574 1/1993

(Continued)

*Primary Examiner*—Rinaldi I. Rada
*Assistant Examiner*—Lindsay Low
(74) *Attorney, Agent, or Firm*—Scott B. Markow

(57) ABSTRACT

A power hammer has a handle mounted to a housing and capable of limited movement relative thereto. A hollow axle is attached to the housing and is rotatable between a first and second position and is biased towards the first position by a torsional spring which extends within the axle. Rotation of the axle causes rotation of arms connected thereto. Connectors are slidably mounted within guides and are respectively connected at one end to each of the arms and at the other end to the handle. Vibrations in the housing cause movement of one end of the handle, which causes movement of the associated connector and arm. Movement of the one arm causes rotation of the axle, which therefore causes movement of the other arm and connector, and the other end of the handle. Thus, the movement of one end of the handle is coupled to the other end.

16 Claims, 3 Drawing Sheets

U.S. PATENT DOCUMENTS

| | | | | |
|---|---|---|---|---|
| 4,800,965 | A | 1/1989 | Keller | |
| 4,936,394 | A | 6/1990 | Ohtsu | |
| 5,025,870 | A | 6/1991 | Gantner | |
| 5,157,807 | A | 10/1992 | Keller et al. | |
| 5,522,466 | A | 6/1996 | Harada et al. | |
| 5,697,456 | A | 12/1997 | Radle et al. | |
| 5,921,327 | A | 7/1999 | Henriksson et al. | |
| H1811 | H | 11/1999 | Rescigno | |
| 6,076,616 | A | 6/2000 | Kramp et al. | |
| 6,123,158 | A | 9/2000 | Steffen | |
| 6,148,930 | A | 11/2000 | Berger et al. | |
| 6,375,171 | B1 | 4/2002 | Zimmerman et al. | |
| 6,421,880 | B1 | 7/2002 | Prajapati et al. | |
| 6,446,421 | B1 | 9/2002 | Kramer et al. | |
| 6,766,868 | B2 | 7/2004 | Frauhammer et al. | |
| 6,843,327 | B2 | 1/2005 | Meixner et al. | |
| 6,863,479 | B2 | 3/2005 | Frauhammer et al. | |
| 7,076,838 | B2 | 7/2006 | Meixner | |
| 7,100,706 | B2 | 9/2006 | Meixner et al. | |
| 2001/0011846 | A1 | 8/2001 | Kondorfer et al. | |
| 2002/0197939 | A1 | 12/2002 | Frauhammer et al. | |
| 2003/0006051 | A1 | 1/2003 | Schmitzer et al. | |
| 2003/0037937 | A1 | 2/2003 | Frauhammer et al. | |
| 2003/0132016 | A1 | 7/2003 | Meixner et al. | |
| 2004/0040729 | A1 | 3/2004 | Meixner | |
| 2004/0231867 | A1* | 11/2004 | Becht et al. | 173/162.2 |
| 2005/0082072 | A1 | 4/2005 | Nicolantonio et al. | |
| 2005/0263307 | A1* | 12/2005 | Stirm et al. | 173/162.2 |
| 2005/0284646 | A1 | 12/2005 | Bacila | |
| 2006/0011365 | A1* | 1/2006 | Stirm et al. | 173/162.2 |
| 2007/0107165 | A1* | 5/2007 | Oddo et al. | 16/431 |

FOREIGN PATENT DOCUMENTS

| | | | |
|---|---|---|---|
| DE | 10036078 | | 2/2002 |
| DE | 100 52 447 | A1 | 5/2002 |
| EP | 0 033 304 | A1 | 8/1981 |
| EP | 1221359 | | 7/2002 |
| GB | 2154497 | | 9/1985 |
| GB | 2 171 045 | A | 8/1986 |
| GB | 2297514 | | 8/1996 |

* cited by examiner

VIBRATION REDUCTION APPARATUS FOR POWER TOOL AND POWER TOOL INCORPORATING SUCH APPARATUS

FIELD OF THE INVENTION

The present invention relates to vibration reduction apparatus for power tools and to power tools incorporating such apparatus. The invention relates particularly, but not exclusively, to vibration reduction apparatus for power hammers, and to hammers incorporating such apparatus.

BACKGROUND OF THE INVENTION

Electrically driven hammers are known in which a driving member in the form of a flying mass is reciprocally driven in a piston, and impact of the flying mass against the end of the piston imparts a hammer action to a bit of the hammer. Such an arrangement is disclosed in European patent application EP1252976 and is shown in FIG. 1.

Referring in detail to FIG. 1, the prior art demolition hammer comprises an electric motor 2, a gear arrangement and a piston drive arrangement which are housed within a metal gear housing 5 surrounded by a plastic housing 4. A rear handle housing incorporating a rear handle 6 and a trigger switch arrangement 8 is fitted to the rear of the housings 4, 5. A cable (not shown) extends through a cable guide 10 and connects the motor to an external electricity supply. When the cable is connected to the electricity supply when the trigger switch arrangement 8 is depressed, the motor 2 is actuated to rotationally drive the armature of the motor. A radial fan 14 is fitted at one end of the armature and a pinion is formed at the opposite end of the armature so that when the motor is actuated the armature rotatingly drives the fan 14 and the pinion. The metal gear housing 5 is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear housing 5. The intermediate gear has a second gear wheel which rotatingly drives a drive gear. The drive gear is non-rotatably mounted on a drive spindle mounted within the gear housing 5. A crank plate 30 is non-rotatably mounted at the end of the drive spindle remote from the drive gear, the crank plate being formed with an eccentric bore for housing an eccentric crank pin 32. The crank pin 32 extends from the crank plate into a bore at the rearward end of a crank arm 34 so that the crank arm can pivot about the crank pin 32. The opposite forward end of the crank arm 34 is formed with a bore through which extends a trunnion pin 36 so that the crank arm 34 can pivot about the trunnion pin 36. The trunnion pin 36 is fitted to the rear of a piston 38 by fitting the ends of the trunnion pin 36 into receiving bores formed in a pair of opposing arms which extend to the rear of the piston 38. The piston is reciprocally mounted in cylindrical hollow spindle 40 so that it can reciprocate within the hollow spindle. An O-ring seal 41 is fitted in an annular recess formed in the periphery of the piston 38 so as to form an airtight seal between the piston 38 and the internal surface of the hollow spindle 40.

When the motor 2 is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate 30 and the crank arm arrangement comprising the crank pin 32, the crank arm 34 and the trunnion pin 36 converts the rotational drive from the crank plate 30 to a reciprocating drive to the piston 38. In this way the piston 38 is reciprocatingly driven back and forth along the hollow spindle 40 when the motor is actuated by a user depressing the trigger switch 8.

The spindle 40 is mounted in magnesium casing 42 from the forward end until an annular rearward facing shoulder (not shown) on the exterior of the spindle butts up against a forward facing annular shoulder (not shown) formed from a set of ribs in the interior of the magnesium casing 42. The ribs enable air in the chamber surrounding the spindle 40 to circulate freely in the region between a ram 58 and a beat piece 64. An increased diameter portion on the exterior of the spindle fits closely within a reduced diameter portion on the interior of the magnesium casing 42. Rearwardly of the increased diameter portion and the reduced diameter portion an annular chamber is formed between the external surface of the spindle 40 and the internal surface of the magnesium casing 42. This chamber is open at its forward and rearward ends. At its forward end the chamber communicates via the spaces between the ribs in the magnesium casing with a volume of air between the ram 58 and the beat piece 64. At its rearward end the chamber communicates via the spaces between the ribs 7 and the recess of the gear casing 5 with a volume of air in the gear casing 5.

The volume of air in the gear casing 5 communicates with the air outside of the hammer via a narrow channel 9 and a filter 11. The air pressure within the hammer, which changes due to changes in the temperature of the hammer, is thus equalised with the air pressure outside of the hammer. The filter 11 also keeps the air within the hammer gear casing 5 relatively clean and dust free.

The ram 58 is located within the hollow spindle 40 forwardly of the piston 38 so that it can also reciprocate within the hollow spindle 40. An O-ring seal 60 is located in a recess formed around the periphery of the ram 58 so as to form an airtight seal between the ram 58 and the spindle 40. In the operating position of the ram 58 (shown in the upper half of FIG. 1), with the ram located behind bores 62 in the spindle, a closed air cushion is formed between the forward face of the piston 38 and the rearward face of the ram 58. Reciprocation of the piston 38 thus reciprocatingly drives the ram 58 via the closed air cushion. When the hammer enters idle mode (i.e. when the hammer bit is removed from a work piece), the ram 58 moves forwardly, past the bores 62 to the position shown in the bottom half of FIG. 1. This vents the air cushion and so the ram 58 is no longer reciprocatingly driven by the piston 38 in idle mode, as is known to persons skilled in the art.

Known hammer drills of this type suffer from the drawback that the hammer action generates significant vibrations, which can be harmful to users of the apparatus, and can cause damage to the apparatus itself.

Solutions to this problem have been proposed, for example, by including in devices of the type shown in FIG. 1 compression springs between either end of handle 6 and the body of the device. However, such springs can cause the handle 6 to experience a rocking motion which results from the spring at one end of handle 6 being compressed whilst the spring at the other end is extended. This is then followed by the previously compressed spring extending whilst the previously extended spring becomes compressed. This rocking motion of the handle is extremely uncomfortable and can be dangerous to the user of the power tool. In particular, the rocking motion is then damped by flexing of the user's wrist, and such repeated flexing sustained by regular-long term use of the power tool could lead to a number of debilitating disorders.

An alternative solution to the above problem is described in European patent application EP0033304 and is shown in FIG.

2. Referring to FIG. 2, the prior art demolition hammer has a pair of handles 102 which are connected to axle 105 by first arms 113. Axle 105 is fixed to housing 101 but is able to rotate relative thereto. Second arms 106 are connected at one end to axle 105 and at the other to compression springs 111, which are themselves connected at their other end to housing 101. As a result, any rotation of axle 105 causes the compression or extension of springs 111. Therefore, any movement of one of handles 102 is transferred down one first arm 113 via axle 105 and along the other first arm 113 to the other handle 102 whilst being damped by springs 111. However, because handles 102 move through an arc there remains a twisting element to the motion of handles 102 as a result of which the device described in EP0033304 cannot easily be adapted to devices of the type shown in FIG. 1.

Another problem with devices of the prior art is that the vibration damping device are large, requiring additional space within the housing of the power tool, and the additional components add weight to the tool, which is also undesirable.

A further problem associated with the prior art is that under different circumstances different spring tensions produce more effective damping of vibrations. It is therefore known to produce power tools having adjustable spring tensioning means, such as that described in EP0033304. However, such devices typically require the housing of the tool to be removed in order to access the tension adjusting means. Furthermore, once access has been established it is also typical to require a specific tool to make the tension adjustment. As a result the tension is rarely adjusted and the full benefit of the vibration damping apparatus is not utilised.

Preferred embodiments of the present invention seek to overcome the above described disadvantages of the prior art.

BRIEF SUMMARY OF THE INVENTION

According to an aspect of the present invention there is provided a handle assembly for a power tool, the assembly comprising:

handle means adapted to be held by a user of the power tool and to be mounted to a housing of the power tool such that the handle means is capable of movement relative to the housing;

axle means adapted to be attached to the housing and to be rotated relative to the housing between a first position and a second position;

torsional biasing means for urging said axle means towards said first position; and at least one arm connected to said handle means and adapted to pivot with said axle means, wherein movement of said handle means relative to said housing along at least one axis in use causes rotation of said axle means relative to the housing.

By using a torsional biasing means to urge the axle means towards the first position, the advantage is provided that the biasing means can be of particularly compact construction since it can extend around or within the axle means. This results in a significant reduction in the space required within the housing to provide effective damping. Furthermore the torsional biasing means does not add significantly to the weight of the device and is surprisingly effective, for its weight, in vibration reduction when compared to devices of the prior art.

In a preferred embodiment said axle means comprises at least one hollow portion and said torsional biasing means is at least partially located in at least one said hollow portion.

By locating the torsional biasing means within a hollow portion of the axle means this provides the advantage that the combined volume required for the axle means and biasing means can be significantly reduced.

The assembly may further comprise a plurality of connectors connected between said handle means and at least one said arm for converting rotational movement of the or each arm into substantially linear movement of said handle means.

By attaching the handle means of a power tool to axle means via at least one arm and connectors, the advantage is provided that vibrations in the handle are damped more effectively than in the prior art. Furthermore, the vibrations are damped without conversion into vibrations in a different direction. In particular, when vibrations cause the movement of one end of the handle, the axle means, in combination with the or each arm and connectors, transfers some of that vibration to the other end of the handle means whilst the biasing means damps the vibration. As a result, the rocking motion of the handle means, as experienced in the prior art, where the spring at one end of the handle means is able to be compressed whilst the spring at the other end of the handle can be extended is reduced. Consequently, the uncomfortable and potentially damaging flexing of the wrist is similarly reduced. Furthermore, because of the linkage of arms and connectors with the handle means, the further advantage is provided that the handle means is not caused to twist in the hand of the user. Thus the reduction or removal of one form of vibration does not introduce an alternative undesirable vibration. This combination of advantages provides a significantly and surprisingly improved reduction in the vibrations of this type of apparatus compared to that experienced in the prior art.

The assembly may further comprise guide means adapted to be connected to said housing and to have said connectors slidably mounted therein.

By providing guide means within which the connectors are slidably mounted the advantage is provided that any non-linear movement of the handle means relative to the housing, such as rattling, is further reduced.

In a preferred embodiment the axis of rotation of the axle means is substantially parallel to a major dimension of the handle means.

In a preferred embodiment the handle means comprises a handle, at least one first said connector is attached adjacent a first end of said handle and at least one second said connector is attached adjacent a second end of said handle.

The biasing means may comprise at least one helical spring.

The biasing means may comprise at least one leaf spring.

In a preferred embodiment, the assembly further comprises adjustment means for adjusting the biasing force of said biasing means.

By providing means for adjusting the biasing force of the biasing means, the advantage is provided that the user is able to select a biasing force in the biasing means which provides a damping effect of the handle which best suits the circumstances in which the tool is being used.

In a preferred embodiment, said adjustment means is adapted to adjust said biasing force in said biasing means by moving and fixing a portion of said biasing means relative to said housing.

In another preferred embodiment said adjustment means comprises at least one cam adapted to rotate about a respective first axis to move and fix a portion of said biasing means relative to said housing.

By providing a cam which operates in the manner described above, this provides the advantage that the cam can be operated by a lever extending outside the housing of the power tool which is rotated to alter the tension in the spring.

As a result it is not necessary to gain access within the housing of the tool to alter the tension of the spring, nor is it necessary to use a specific tool.

In a further preferred embodiment, rotation of at least one said cam about a corresponding axis causes movement of a portion of said biasing means in a direction substantially parallel to the axis of rotation of the cam.

By providing the adjusting means such that the rotation of the cam results in movement of the biasing means in a direction which is substantially parallel to axis of rotation of the cam, the advantage is provided that a large movement of the lever can result in a small movement of the portion of the biasing means which is engaged with the cam. This therefore allows for considerable sensitivity in the adjustment in the tension of the biasing means.

According to another aspect of the present invention, there is provided a power tool comprising:

a housing;

a motor in the housing for actuating a working member of the tool; and a handle assembly as defined above.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE INVENTION

Figure 1:
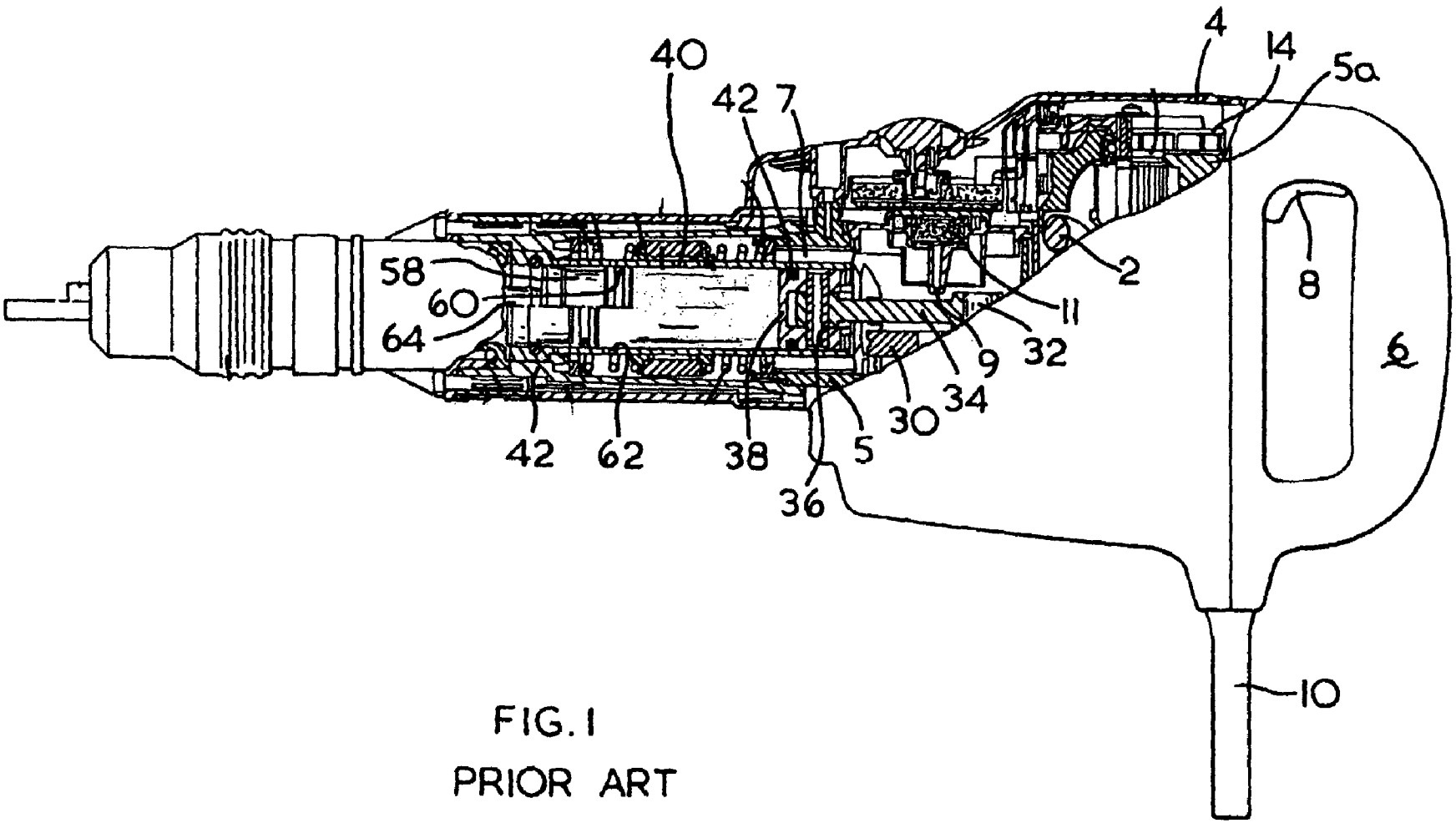
FIG. 1 PRIOR ART
FIG. 1 is a partially cut away side view of a first prior art demolition hammer.
Figure 2:
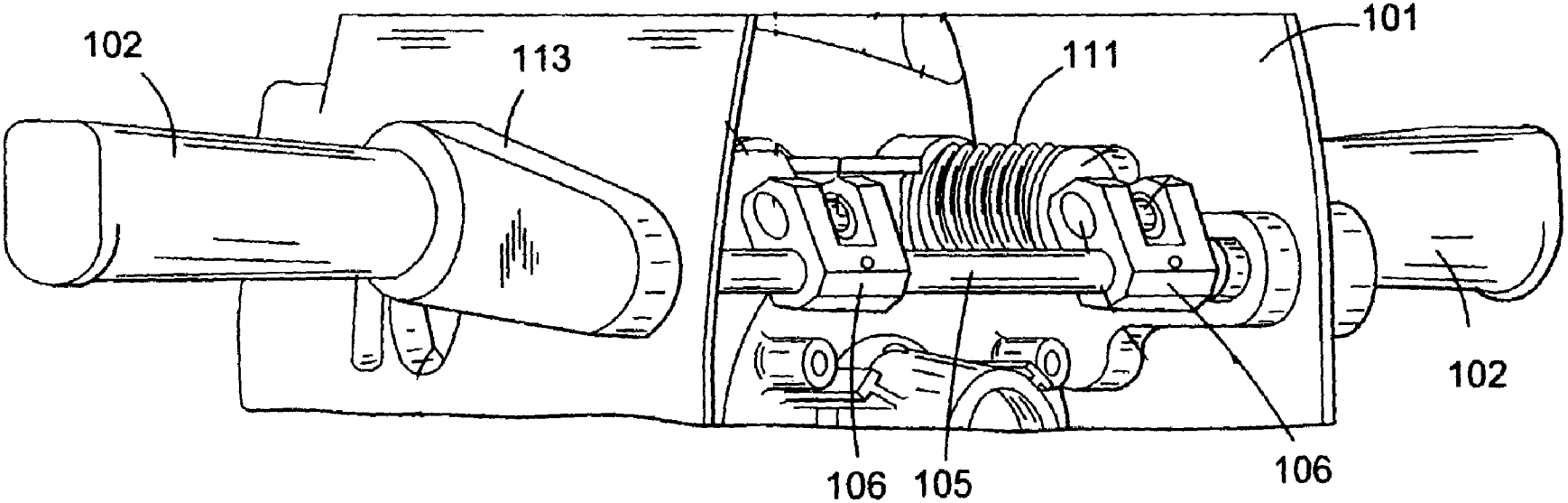
FIG.2 PRIOR ART
FIG. 2 is a perspective view of a handle assembly of a second prior art demolition hammer.
Figure 3:
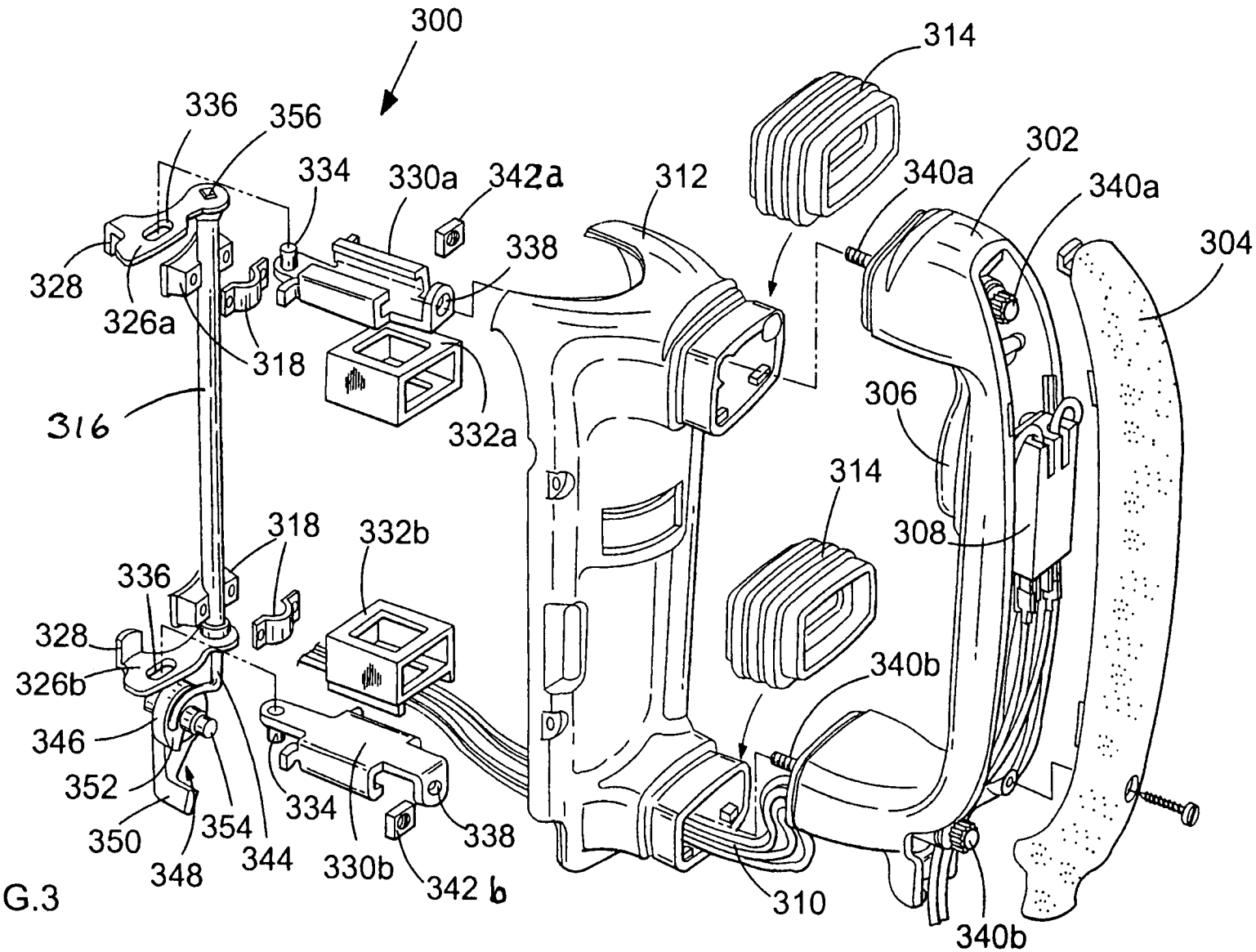
FIG. 3 is an exploded perspective view of a handle assembly embodying the present invention.

Referring to FIG. 3, a handle assembly 300 for use as part of a power hammer (not shown) has a handle 302 which has a rubberised gripping portion 304. Handle 302 also has a trigger 306 which activates switch 308 and provides power to the hammer mechanism via cables 310.

Handle 302 is mounted to the housing 312 of the power tool, only a portion of which is shown in FIG. 3, and handle 302 is capable of limited movement relative to housing 312. Rubberised sleeves 314 cover the joint between handle 302 and housing 312.

The handle assembly also has a hollow axle 316 which is attached to the housing 312 by brackets 318 and is able to rotate relative to the housing 312 between a first position and a second position. Axle 316 is biased towards said first position by biasing means in the form of a torsional spring 344. Torsional spring 344 extends within hollow axle 316 and is fixed at one end relative to housing 312 by engaging portion 346 which engages adjusting means 348 but is able to rotate, at that end, relative to andwithin hollow axle 316. The other end of torsional spring 344 (a portion of which can be seen at 356) is able to rotate relative to the housing 312 but is fixed relative to axle 316. Thus torsional spring 344 biases axle 316 towards a first position.

Arms 326*a* and 326*b* are fixed relative to axle 316 such that rotation of axle 316 causes rotation of arms 326*a* and 326*b*. Stops 328 engage respective portions (not shown) of the housing 312, thereby preventing movement of arms 326*a* and 326*b* beyond a predetermined position. The handle assembly 300 also has connectors 330*a* and 330*b* which are slidably mounted within guides 332*a* and 332*b* respectively, which are themselves fixed relative to housing 312. Connectors 330*a* and 330*b* each have a respective pin 334 at one end which extends into respective aperture 336 in arms 326*a* and 326*b*. At the other end of each connector 330*a* and 330*b* apertures 338 receive bolts 340*a* and 340*b* respectively and the connectors 330*a* and 330*b* are fixed to the handle 302 by means of respective nuts 342*a* and 342*b*. Bolts 340*a* and 340*b* extend into and are fixed relative to handle 302.

The assembly 300 is also provided with means for adjusting the tension in torsional spring 344. Adjusting means 348 has a lever 350 which extends outside the housing of the power tool to enable it to be actuated by a user of the tool. It also has a cam surface 352 and is mounted on and rotatable at least partially around an axle 354.

In use, if vibrations in the body of the power tool, such as a hammer, to which handle assembly 300 is connected cause movement of one end, for example the upper end as shown in FIG. 3, of handle 302 relative to housing 312, movement of handle 302 causes movement of connector 330*a* since it is fixed relative to handle 302 by bolt 340*a* which extends through hole 338 and is fixed by nut 342. Movement of connector 330*a* in turn causes movement of arm 326*a*, which is damped by torsional spring 344. At the same time, movement of arm 326*a* results in rotation of axle 316 which therefore causes movement of the other arm 326*b*. As a result, movement of one arm 326*a* automatically causes the movement of the other arm 326*b*. Movement of arm 326*b* in turn causes connector 330*b* to slide within guide means 332*b* and by virtue of the fixed connection between connector 330*b* and bolt 340*b*, the lower end of handle 302 is caused to move relative to housing 312.

As a result, it can be seen that movement of one end of handle 302 will result in an equivalent movement of the other end of handle 302. Thus the tendency for the opposing ends of handle 302 to pivot about an axis transverse to the longitudinal axis of the handle 302, and the resultant dangerous flexing of the wrist, is reduced. The use of connectors 330*a* and 330*b* further ensures that the movement of handle 302 does not rotate along its length as a result of the movement of arms 326*a* and 326*b*.

The tension in torsional spring 344 may be adjusted by movement of adjusting means 348. Lever 350 is moved, causing rotation of adjusting means 348 around axle 354. As a result of this rotation, cam surface 352 causes arm portion 346 of spring 344 to be moved axially along axle 354, and more or less tension is applied to torsional spring 344, depending on the position of lever 350.

It will be appreciated by persons skilled in the art that the above embodiment has been described by way of example only, and not in any limitative sense, and that various alterations and modifications are possible without departure from the scope of the invention as defined by the appended claims. For example, additional biasing means may be included for example helical springs or leaf springs.

The invention claimed is:

1. A handle assembly for a power tool, the assembly comprising:

a handle adapted to be held by a user of the power tool and mounted to a housing of the power tool such that the handle is capable of movement relative to the housing;

an axle connected to the housing and rotatable relative to the housing between a first position and a second position, said axle including a hollow portion;

a torsional biasing element for urging said axle towards said first position, said torsional biasing element at least partially located in said hollow portion of said axle; and an arm connected to said handle and adapted to pivot with said axle, wherein movement of said handle relative to said housing along at least one axis causes rotation of said axle relative to the housing.

2. An assembly according to claim 1, further comprising a connector connected between said handle and said arm for converting rotational movement of the arm into substantially linear movement of said handle.

3. An assembly according to claim 2, further comprising a guide connected to the housing and the connector is slidably mounted in the guide.

4. An assembly according to claim 1, wherein the axis of rotation of the axle is substantially parallel to a major dimension of the handle.

5. An assembly according to claim 2, wherein said connector is a first connector attached adjacent a first end of said handle, and the assembly further comprises a second connector attached adjacent a second end of said handle.

6. An assembly according to claim 1, further comprising adjustment means for adjusting the biasing force of said biasing element.

7. An assembly according to claim 6, wherein said adjustment means is adapted to adjust said biasing force in said biasing element by moving and fixing a portion of said biasing element relative to said housing.

8. An assembly according to claim 6, wherein said adjustment means comprises at least one cam adapted to rotate about a respective first axis to move and fix a portion of said biasing element relative to said housing.

9. An assembly according to claim 8, wherein rotation of said cam about the first axis causes movement of a portion of said biasing element in a direction substantially parallel to the axis of rotation of the cam.

10. A power tool comprising:

a housing;

a motor in the housing for actuating a working member of the tool; and a handle assembly including:

a handle adapted to be held by a user of the power tool and mounted to a housing of the power tool such that the handle is capable of movement relative to the housing;

an axle connected to the housing and rotatable relative to the housing between a first position and a second position, said axle including a hollow portion;

a torsional biasing element for urging said axle towards said first position, said torsional biasing element at least partially located in said hollow portion of said axle; and an arm connected to said handle and adapted to pivot with said axle, wherein movement of said handle relative to said housing along at least one axis causes rotation of said axle relative to the housing.

11. A power tool according to claim 10, further comprising a connector connected between said handle and said arm for converting rotational movement of the arm into substantially linear movement of said handle.

12. A power tool according to claim 10, further comprising a guide connected to the housing and the connector is slidably mounted in the guide.

13. A power tool according to claim 10, wherein the axis of rotation of the axle is substantially parallel to a major dimension of the handle.

14. A power tool according to claim 11, wherein said connector is a first connector attached adjacent a first end of said handle, and the assembly further comprises a second connector attached adjacent a second end of said handle.

15. A power tool according to claim 10, further comprising adjustment means for adjusting the biasing force of said biasing element.

16. A power tool according to claim 15, wherein said adjustment means comprises at least one cam adapted to rotate about a respective first axis to move and fix a portion of said biasing element relative to said housing.

* * * * *